United States Patent [19]

Ogden et al.

[11] 3,952,907

[45] Apr. 27, 1976

[54] LIQUID STORAGE INSTALLATIONS

[75] Inventors: Dennis H. Ogden, Wolverhampton; George Inverarity, Brierley Hill, both of England

[73] Assignee: British Industrial Plastics Limited, Manchester, England

[22] Filed: Nov. 25, 1974

[21] Appl. No.: 527,157

[30] Foreign Application Priority Data

Nov. 24, 1973 United Kingdom ..... 54674/73

[52] U.S. Cl. ..... 220/18; 61/35; 137/312; 220/1 B

[51] Int. Cl.[2] ..... B65D 87/00

[58] Field of Search ..... 61/35, 36 R, 1 R, 1; 220/18, 88 R, 1 B; 137/312

[56] References Cited

UNITED STATES PATENTS

| | | | |
|---|---|---|---|
| 3,047,184 | 7/1962 | Van Bergen et al. | 220/88 R |
| 3,096,902 | 7/1963 | Schroeder | 220/18 |
| 3,329,231 | 7/1967 | Takenouchi | 137/312 |
| 3,505,769 | 4/1970 | Miron et al. | 220/18 |
| 3,736,758 | 6/1973 | Dolfing et al. | 61/36 R |

FOREIGN PATENTS OR APPLICATIONS

| | | |
|---|---|---|
| 1,282,103 | 7/1972 | United Kingdom |

OTHER PUBLICATIONS

"Product Engineering", Nov. 20, 1967, pp. 127, 128.

*Primary Examiner*—Robert L. Wolfe
*Assistant Examiner*—Alex Grosz
*Attorney, Agent, or Firm*—Baldwin, Wight & Brown

[57] ABSTRACT

A liquid storage installation comprising a tank and a bund below the tank is provided with means for rendering rupture of the tank less dangerous by filling the bund, or by covering the bund and optionally also the tank, with a body of a permeable material capable of absorbing liquid from the tank; preferably the permeable material is an aminoplast foam.

9 Claims, 3 Drawing Figures

LIQUID STORAGE INSTALLATIONS

This invention concerns improvements in or relating to liquid storage installations.

At present, many bulk storage installations for liquids comprise a bulk storage tank supported above an open-topped reservoir or "bund" so that if the tank ruptures or otherwise develops a leak, the liquid will fall into the bund and be thereby contained from spreading over the area around the tank. In the case of installations for storage of inflammable liquids, there is still a serious fire-hazard, since the liquid remains exposed to atmosphere; furthermore, a serious risk of explosion also results, since the bund necessarily has a relatively large surface, leading to fast evaporation if the liquid is particularly volatile. Even if the liquid is not particularly volatile, there is still the risk of noxious or corrosive fumes being generated.

According to the present invention, a liquid storage installation comprises a tank and a bund, wherein the bund is covered by a layer of, or is at least partly filled with a body of, non-inflammable material permeable to the liquid, impermeable to water and having low thermal conductivity.

Optionally, the tank is covered at least partly by said material.

Preferably the permeable material is an aminoplast resin foam, more preferably a low density urea formaldehyde or melamine-formaldehyde resin foam of the type described in, for example, our U.K. Pat. Specification No. 1,282,103; alternatively it may be of phenolic or urethane resin foam or of porous cementitious material.

By the term "low thermal conductivity" is meant a thermal conductivity considerably lower than that of the tank, for example a thermal conductivity of less than 10, more preferably less than 5 BThU in/f²h°F.

Preferred embodiments of the invention will now be described by way of example with reference to the accompanying drawings wherein.

Figure 1:
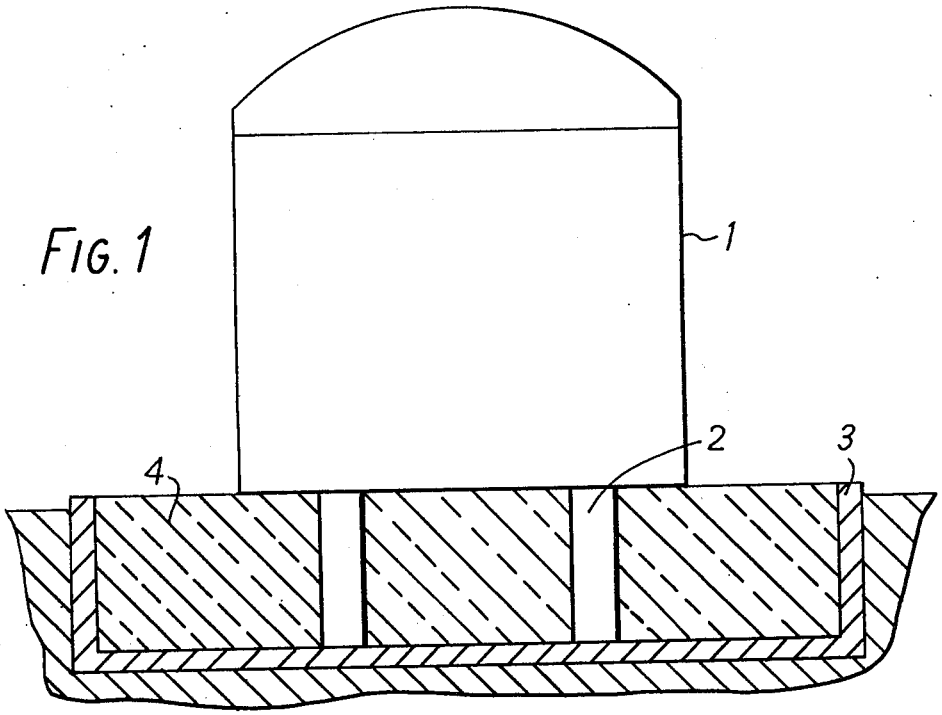
FIG. 1 is a diagrammatic cross-section of a petroleum storage installation.

Referring to FIG. 1 a petroleum storage installation comprises a sealed tank 1 supported on pillars 2 above the floor of a bund 3 sunk below ground level, and upper surface, space within the bund has been filled with urea formaldehyde resin foam 4, sprayed in provides and allowed to cure. The urea formaldehyde resin used is that described in our U.K. Pat. Specification No. 1,282,103, which cures to a low density foam which we have found has the property of absorbing up to about 70% or more of its volume of peroleum spirit. Thus, if the bund has a sufficiently large volume, the foam therein will absorb all the petroleum in the tank 1, should the tank rupture or otherwise developd a leak. That is, the bulk volume of the foam should be sufficiently great as to enable it to contain all the liquid and have a zone in the form of a layer, at or near its upper-surface, not saturated with the liquid. This zone, although not necessarily reducing the risk of ignition, provide a means whereby the intensity of any resultant fire is considerably reduced.

In a modification the space within the bund is partly filled with suitably shaped blocks of cured urea formaldehyde resin foam (urea formaldehyde resin foam being used for grouting between the blocks, if necessary) so that the foam will float on liquid in the bund when a certain volume of liquid has accummulated therein, thereby mitigating risk of an explosion.

Figure 2:
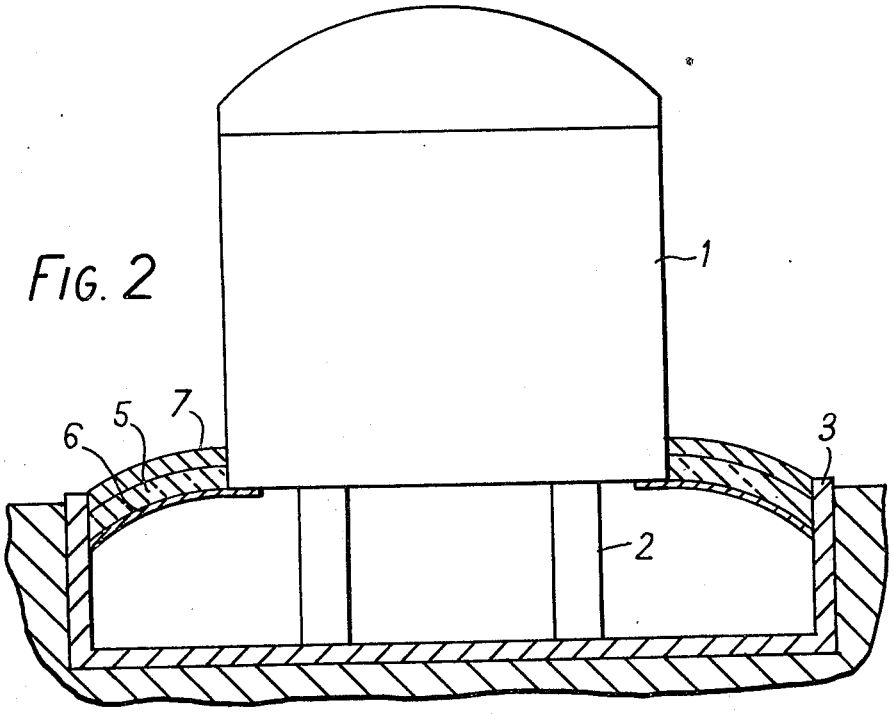
FIG. 2 is a similar view of a different type of installation.

Referring to FIG. 2, a petroleum storage installation comprises a sealed tank 1 supported on pillars 2 above the floor of a bund 3 sunk below ground level, as in FIG. 1, but in this embodiment the bund is provided with a cover comprising a permeable layer 5 of cured urea formaldehyde resin foam supported on a permeable member 6 such as "chicken netting" attached to the bottom of the tank 1 and to the sides of the bund 3 and a permeable layer 7 of perlite-filled cured urea formaldehyde resin foam of the type described in our Belgian Patent specification No. 813,146; this type of material has very high flame-resistance, high wear resistance, and hence good weather resistance, but has somewhat lower absorbency. The layers 5 and 7 are formed in situ.

Again, many modifications can be made. For example, the layer 7 may be omitted; alternatively a single layer of urea formaldehyde resin foam-bonded perlite may be used in place of the layers 5 and 7; and fillers other than perlite, for example vermiculite, may be used. If the cured aminoplast resin foam was sufficient inherent rigidity, the permeable member 6 may be omitted, but in this case the cover will be pre-formed for example as a plurality of suitably shaped blocks of the foam.

Figure 3:
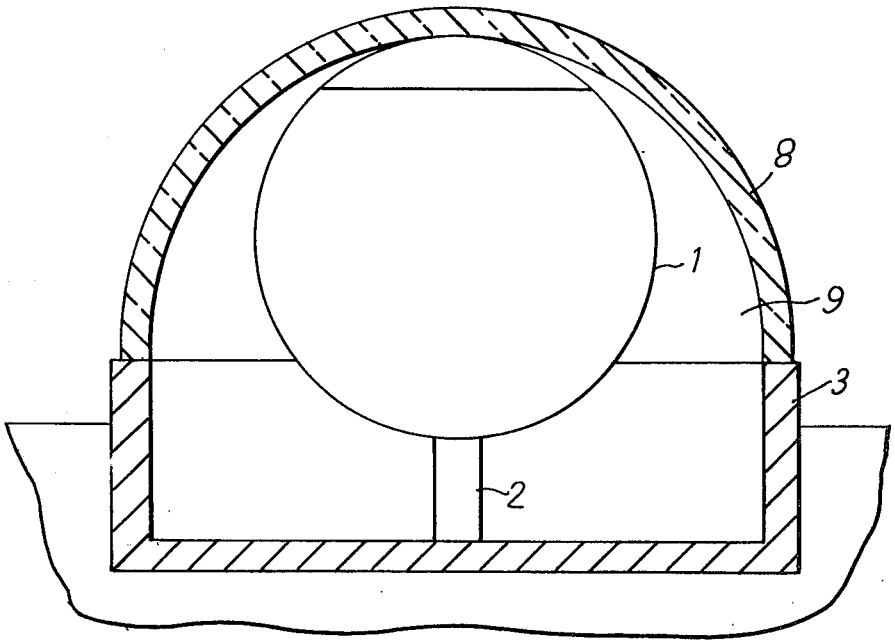
FIG. 3 is an develop view of a modified form of installation.

In FIG. 3, a cylindrical tank 1 is mounted on supports 2 above the floor of a bund 3 and is covered by a semi-cylindrical cover 8 of cured urea formaldehyde resin foam or other permeable material located on the walls of the bund. The cover 8 is provided with end walls 9 of permeable material so that the tank 1 and bund 3 are totally enclosed.

In this modification, a further modification comprises providing a body of permeable material in the bund, as described with reference to FIG. 1, extended to encapsulte the tank.

In all these embodiments and modifications the tank inlet and/or outlet may be protected by the permeable material, for example by placing such inlet and/or outlet within the bund.

An important feature of the above embodiments is that cured aminoplast resin foams of the type described above will char on their exposed surface(s) when vapor from inflammable liquid therein, or inflammable vapor permeating therethrough, goes on fire; this charring results in "skinning over" of the foam, with a layer of char which appears to be intumescent or otherwise to be acting as a barrier to vapor or liquid made available to feed the fire is considerably reduced with resultant reduction of the intensity of the fire.

An important aspect of the invention is that the use of a permeable material as a 'filling' in (or cover for) the bund permits drainage of the liquid therethrough, leaving at least a surface zone (or substantially the entire cover) of the body of permeable material free from liquid, which zone acts as a barrier to fire propagation.

In addition the low thermal conductivity of the foam provides for low heat transfer therethrough, and thus minimises vaporisation of the liquid in or below the foam.

The concept of this invention can be applied to storage installations for other hazardous liquids, but is at present considered particularly applicable in inflammable liquid storage installations.

The following tests illustrate the reduction in fire hazard that can be achieved.

TEST A i. Approximately 90 gallons of a 92 octane petrol were placed in a a shallow receptacle measuring about 15 feet square and containing about three-fourths inch of water. The petrol was ignited, and the resultant fire was attacked with standard protein foam delivered from a high-delivery fire appliance. It was about four minutes before the fire was smothered.

ii. A block of cured urea formaldehyde resin foam (of the type described in U.K. Patent Specification No. 1,282,103) measuring 15 feet square and having a bulk volume of about 340 cubic feet, assembled from nine smaller blocks, was impregnated with 90 gallons of a 92 octane petrol. The petrol was ignited and the resultant fire was attacked with two standard water mist sprays, each delivering about 12 gallons of water mist per minute. The fire was extinguished in only 1 minute, whereas a fire as described in part (i) above could not be controlled at all with these sprays.

TEST B i. Approximately 135 gallons of jet aircraft kerosene, placed in a receptacle as in Test A, part (ii) (without the water) was ignited and the resultant fire attacked with medium expansion protein foam from a high-delivery fire appliance. This fire was controlled in about 30 seconds.

ii. A block of foam as described in Test A, part (ii) was impregnated with 135 gallons of jet aircraft kerosene. It was extremely difficult to ignite the kerosene in this part of the test, and even when it was ignited at one corner of the block, the fire would not spread. Fire spread was encouraged by directing liquid kerosene onto the top surface of the block, but even then very little of the original kerosene in the block would burn.

In both of parts (ii) of the above tests, the foam itself did not burn, there was only very little penetration of the flame into the surface of the blocks, and the surfaces of the block in each case charred and "skinned", effectively further reducing the amount of vapour available to feed the fire. The degree of "wicking" of the fuel from the lower portions of the block to the top surface is extremely low.

In all the various embodiments of this invention, the low degree of wicking is an important factor and the pore size and surface properties of the permeable material can be chosen to maximise rapid wetting of the material by the liquid under storage and to minimise retention of the liquid in the upper layer of the permeable material. The permeable material should be of essentially open cell structure.

It will be appreciated that the cured urea-formaldehyde foam used in the embodiments described above can be replaced by any material which has similar physical properties, at least those properties pertinent to the concept of the invention; for example, melamine-formaldehyde foam is the next best alternatively. Phenol formaldehyde foam or polyurethane foam may be used, but these materials have distinct disadvantages such as being more expensive, or not skinning on their surface when exposed to fire, or, in the case of polyurethane, being liable to evolve noxious gases when in contact with fire. Porous cement may also be used as an alternative, but again does not provide a skinning effect when exposed to fire, it is also much heavier, more expensive, and more difficult to remove should it be necessary to strip the protection from an installation, during demolition or maintenance of the installation.

It will also be appreciated that the tank may rest directly on the bottom surface of the bund, that the bund should be of sufficient volume to contain the maximum volume of liquid to be held in the tank, and that the plan area of the bund should be greater than the maximum plan area of the tank. The invention finds equal application in the storage of whisky and other inflammable liquors, and in the storage of aggresive liquids such as acids.

We claim:

1. A liquid storage installation comprising tank means for storage of a liquid of the class including inflammable liquids and liquids which produce fumes of the volatile, noxious, corrosive and the like type; bund means below the tank means for entrapment of such liquid spilled from the tank means and of a size generally corresponding in volume to at least that of said tank means, said bund means including bottom and side walls, and protective means for protecting the environment from harmful effects of such liquid when spilled into the bund means; the protective means comprising a body of non-inflammable material permeable to the liquid, essentially impermeable to water whereby it may be exposed to the elements, having relatively low thermal conductivity, and selected from the group consisting of an aminoplast resin foam, a phenolic resin foam and a urethane resin foam, said body of non-inflammable material covering the bund bottom wall.

2. A liquid storage installation according to claim 1, wherein the permeable material is a urea formaldehyde resin foam.

3. A liquid storage installation according to claim 2, wherein the resin foam contains a filler.

4. A liquid storage installation according to claim 1, wherein said permeable material has been formed in situ.

5. A liquid storage installation according to claim 1, wherein the permeable material has a thermal conductivity of less than 5 B ThU.in/f$^2$h°F.

6. A liquid storage installation according to claim 1, wherein the permeable material covers both the bund means and the tank means.

7. A liquid storage installation according to claim 1 wherein said permeable material is received in and at least partially fills said bund.

8. A liquid storage installation according to claim 1 wherein said permeable material extends from said tank means to an upper part of said bund means side wall.

9. A liquid storage installation according to claim 1 wherein said permeable material extends from said tank means to an upper part of said bund means side wall and is spaced above said bund means bottom wall.

* * * * *